US005152019A

United States Patent [19]

Hirata

[11] Patent Number: 5,152,019

[45] Date of Patent: Oct. 6, 1992

[54] MATTRESS AND CUSHION MATERIAL

[76] Inventor: Koichi Hirata, 3470 Oaza Sasaga, Matsumoto City, Nagano Pref., Japan

[21] Appl. No.: 583,864

[22] Filed: Sep. 17, 1990

[30] Foreign Application Priority Data

Jul. 17, 1990 [JP] Japan ..... 2-75240

[51] Int. Cl.[5] ..... A47C 27/00

[52] U.S. Cl. ..... 5/448; 5/636

[58] Field of Search ..... 5/448, 450, 434, 482, 5/481; 428/144, 357, 403, 407; 273/58 A; 206/814

[56] References Cited

U.S. PATENT DOCUMENTS

| | | | |
|---|---|---|---|
| 2,745,375 | 5/1956 | Frederick | 5/448 X |
| 2,978,351 | 4/1961 | Pullar | 428/403 |
| 3,248,738 | 5/1966 | Morgan | 5/481 X |
| 3,359,130 | 12/1967 | Goldman | 428/407 |
| 3,840,920 | 10/1974 | Voelker | 5/450 |
| 3,927,882 | 12/1975 | Galarza | 273/58 A X |
| 4,065,599 | 12/1977 | Nishiumi et al. | 5/448 X |
| 4,407,031 | 10/1983 | Michiels | 5/481 X |
| 4,496,627 | 1/1985 | Azuma et al. | 428/403 X |
| 4,945,591 | 8/1990 | Inagaki | 5/448 X |

FOREIGN PATENT DOCUMENTS

| | | | |
|---|---|---|---|
| 2-154009 | 6/1990 | Japan | 5/482 |
| 9786 | of 1900 | United Kingdom | 273/58 A |
| 314180 | 6/1929 | United Kingdom | 273/58 A |

*Primary Examiner*—Michael F. Trettel

*Attorney, Agent, or Firm*—Andrus, Sceales, Starke & Sawall

[57] ABSTRACT

The present invention provides a cushion material including padding elements, each of which consists of a core and an outer resilient layer surrounding the core.

8 Claims, 2 Drawing Sheets

MATTRESS AND CUSHION MATERIAL

BACKGROUND OF THE INVENTION

1. Field of the Invention

The present invention relates to an improved cushion material and, more particularly, to such a cushion material including padding elements each of which consists of a core and an outer layer surrounding the core.

2. Description of the Prior Art

In Japan, it is currently known to use buckwheat chaff as padding in pillows and cushions. The buckwheat chaff is inexpensive, but not sanitary since it may causes an allergic reaction against some users and/or provide a forcing bed in which various bacteria and harmful insects (such as ticks or deathwatches) increase.

As high-quality padding, feathering and kapok have been similarly utilized since they have a good air-permeability, a high resiliency and a very good feel. These high-quality paddings will not prevent the increase of various bacteria and harmful insects.

In order to overcome these problems, it has been proposed to use adzuki beans, soy beans or wood chips since they have properties similar to those of the buckwheat chaff and can relatively prevent the increase of various bacteria and insects. However, the last-mentioned cushion materials are expensive and cannot continue their superior properties for a long time.

In place of such non-sanitary cushion materials, more recently, it has been proposed to use padding of plastics, metal or ceramics. In comparison with the natural padding such as buckwheat chaff, the plastics, metal or ceramics padding has less hygroscopicity, heavier, more noisy, feel hard and is easily molded. Eventually, they may provide a forcing bed in which various bacteria and insects increase.

The present invention is directed to an improved cushion material which can overcome the aforementioned problems in the prior art while maintaining the superior properties of the prior art paddings.

SUMMARY OF THE INVENTION

The present invention provides a cushion material including padding elements each of which includes a core and an outer layer surrounding the core.

In one aspect, the core of each of the padding elements may be formed of such a material that can relatively prevent the increase of various bacteria and insects. The outer layer surrounding the core may be made of a soft material which also serves to reduce the weight of the cushion material.

DETAILED DESCRIPTION OF PREFERRED EMBODIMENTS

Figure 1:
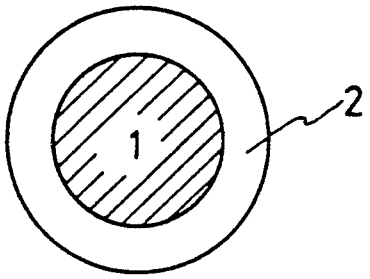
FIG. 1 is a cross-sectional view of a padding element used in the cushion material according to the present invention.
Figure 2A:
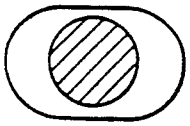
FIGS. 2A to 2E illustrate various forms of padding elements usable in the cushion material of the present invention.
Figure 2B:
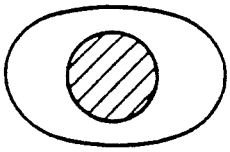
Figure 2C:
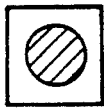
Figure 2D:
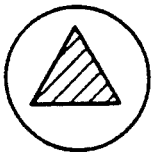
Figure 2E:
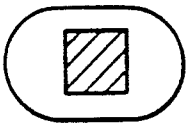

Referring first to FIG. 1, there is shown a padding element used in a cushion material according to the present invention, which comprises a core 1 and an outer layer 2 completely surrounding the core 1.

The core 1 may be formed of any suitable material which is sanitarily clean and can prevent the increase of various bacterial and harmful insects. Such a material is preferably selected from a group consisting of natural material such as wood chips, bamboo chips, natural organic materials, metals, rocks and materials obtained by processing these natural materials, synthetic organic or inorganic materials such as plastics, ceramics, rubbers and processed materials, and a combination of one or more materials mentioned above.

The core 1 may take any suitable geometric configuration such as sphere, cube, rectangular parallelepiped, column, bullet, body of revolution or the like or any other configuration such as irregular form, hollow form, foamed form, perforated form. Various possible shapes of the core 1 are shown in FIGS. 2A–2E. However, the core 1 usable in the present invention is not limited to such illustrated shapes, but may take any other desirable shape within the scope of the invention.

The core 1 may be formed of a magnetic material or take hollow, foam or perforated form containing perfume, insecticide, coolant or the like.

The outer layer 2 surrounding the core 1 may be formed of any suitable material which feels soft and provides air-permeability, such as plastics, rubber, ceramics, metal foam or the like. The outer layer 2 may also be made of a low specific gravity material, for example, which is obtained by completely or partially compacting natural or synthetic bristles into an integral body under use or non-use of adhesive.

Various shapes of the outer layer 2 are shown in FIGS. 2A–2E. It is to be understood that the present invention will not be limited to such shapes of the outer layer 2, but may be carried out with any other suitable configuration of the outer layer 2.

The outer layer 2 is preferably of a thickness ranged between one millimeter and ten millimeters. If the thickness of the outer layer 2 is less than one millimeter, the padding element will have its weight insufficient to provide the desired resiliency. If the thickness of the outer layer 2 is larger than 10 mm, the hardness and other properties of the core 1 in the padding element cannot be sufficiently utilized to provide the desired characteristics in the padding.

Figure 3:
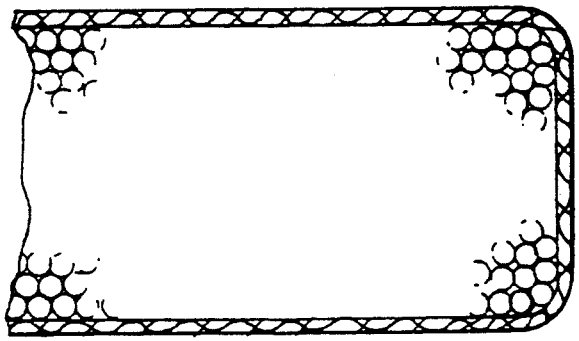
FIG. 3 is a view illustrating an aggregate of the padding elements shown in FIG. 1 contained within a cushion.

As shown in FIG. 3, an aggregate of padding elements, such as those illustrated in FIG. 1, are contained within a casing or cover, to form a pillow, cushion or the like.

The present invention will be better understood from reading some examples which will be described below.

EXAMPLE 1

A pillow, such as shown in FIG. 3, was made using a cushion material consisting of padding elements each of which included a core made of a glass ball and having a diameter equal to five millimeters and an outer layer of foamed polystyrene having a thickness equal to one millimeter.

A pillow padded only by glass balls produced a shrill and creaky noise and was heavier, easily damaged and inconvenient to handle. When padding elements each consisting of a glass ball and an outer layer of foamed polystyrene surrounding the glass ball were used to pad a pillow, this pillow did not produce such noise as described above, with the glass balls being protected sufficiently from being damaged. This pillow also provided a good feel in use.

EXAMPLE 2

Sofa cushion was padded by padding elements each of which consists of a ground stone piece of a size ranged between five millimeters and then millimeters and an outer layer of a bristle sheet which was formed of coconut fibers and had a thickness equal to seven millimeters.

This sofa cushion did not provide any unpleasant feel due to the sharp tips of the ground stone pieces. Further, it was reduced in weight, less noisy and provided a very pleasant feel in use.

EXAMPLE 3

Cushion material was made of padding material each of which included a magnet piece of 3 mm cubic and a hollow column-like rubber sponge member in which such magnet pieces were compacted, the rubber sponge member having an external diameter equal to 10 millimeters and a length equal to 25 millimeters.

The resulting cushion material was light, less noisy and provided no unpleasant feel due to the sharp corners of the magnet pieces. The magnet pieces advantageously influenced the health of a user.

EXAMPLE 4

A pillow was padded by padding elements each of which consisted of a floatstone having a size ranged between three millimeters and seven millimeters and impregnated with a perfume and an outer layer of wood felt having a thickness ranged between three millimeters and five millimeters.

The resulting pillow provided a soft feed and was less noisy. Further, the pillow was of a high quality that the perfume suitably floats in the air.

Although the present invention has been described and illustrated as to some preferred embodiments, it is to be understood that the present invention is not limited to such embodiments, but may be carried out with any other configuration without departing the spirit and scope of the invention.

I claim:

1. A cushion, comprising an aggregate of individual non-cylindrical padding elements contained within a casing, each padding element consisting of a core and an outer layer surrounding said core, wherein the material of said core is different than that of said outer layer, and wherein said outer layer is formed of a resilient material having sufficient thickness to impart resiliency to said outer layer.

2. A cushion as defined in claim 1 wherein the material of said cores is selected from a group consisting of wood, ceramics, metal rubber, or plastics.

3. A cushion as defined in claim 1, wherein the material of said outer layers is selected from a group consisting of rubber or plastics.

4. A cushion as defined in claim 1 wherein said core and/or outer layer are air-permeable.

5. A cushion, comprising an aggregate of individual non-elongated padding elements contained within a casing, each padding element consisting of a core and an outer layer surrounding said core, wherein the material of said core is different than that of said outer layer, and wherein said outer layer is formed of a resilient material having sufficient thickness to impart resiliency to said outer layer.

6. A cushion, comprising an aggregate of individual padding elements contained within a casing, each padding element consisting of a core in the shape of a sphere, and an outer layer surrounding said core, wherein the material of said core is different than that of said outer layer, and wherein said outer layer is formed of a resilient material having sufficient thickness to impart resiliency to said outer layer.

7. A cushion, comprising an aggregate of individual padding elements contained within a casing, each padding element consisting of a core in the shape of a rectangular parallelipiped, and an outer layer surrounding said core, wherein the material of said core is different than that of said outer layer, and wherein said outer layer is formed of a resilient material having sufficient thickness to impart resiliency to said outer layer.

8. The cushion of claim 7, wherein the core of each padding element is in the shape of a cube.

* * * * *